United States Patent [19]

Aigo

[11] Patent Number: 4,759,817

[45] Date of Patent: Jul. 26, 1988

[54] APPARATUS FOR ETCHING SEMICONDUCTOR MATERIAL

[76] Inventor: Seiichiro Aigo, 3-15-13 Negishi, Daito-ku, Tokyo, Japan

[21] Appl. No.: 921,395

[22] Filed: Oct. 22, 1986

[30] Foreign Application Priority Data

May 15, 1986 [JP] Japan ..... 61-73739[U]

[51] Int. Cl.[4] ..... C23F 1/02

[52] U.S. Cl. ..... 156/345; 156/627

[58] Field of Search ..... 134/56 R, 57 R; 156/627, 345

[56] References Cited

U.S. PATENT DOCUMENTS

| | | | |
|---|---|---|---|
| 3,953,265 | 4/1976 | Hood | 156/345 X |
| 4,338,157 | 7/1982 | Kanda | 156/345 X |
| 4,339,297 | 7/1982 | Aigo | 156/345 |
| 4,358,338 | 11/1982 | Donney et al. | 156/627 |

FOREIGN PATENT DOCUMENTS

| | | | |
|---|---|---|---|
| 36473 | 4/1978 | Japan | 156/627 |
| 62169 | 5/1980 | Japan | 156/627 |
| 114579 | 6/1985 | Japan | 156/627 |

*Primary Examiner*—Philip R. Coe

*Attorney, Agent, or Firm*—Wegner & Bretschneider

[57] ABSTRACT

This invention relates an apparatus for etching a film such as an oxide film applied on one surface of a semiconductor material, and the apparatus includes a cup-shaped basin, a chuck for supporting a semiconductor material to be treated at lower surface thereof and a pair of electrical terminals contacting with an etchant which has just contacted with a film. The chuck is rotatably mounted spaced above the basin. The electric terminals detect changes of ionic density in the etchant in order to discriminate an end point of etching. A point of re-increase in ionic density in etchant is used as an etching end point.

6 Claims, 2 Drawing Sheets

APPARATUS FOR ETCHING SEMICONDUCTOR MATERIAL

BACKGROUND OF THE INVENTION

1. Field of the Invention

This invention relates to an apparatus for etching a semiconductor material such as silicon wafer or glass photomask, and more particularly to an apparatus for etching a film such as an oxide film to be treated, applied on one of the surfaces of a semiconductor material.

2. Description of the Prior Art

In manufacture of semiconductor circuits, an oxide film is formed on one of the surfaces of a semiconductor material such as a silicon wafer, and then etching of such an oxide film is carried out in order to permeate diffusion material of P-type or N-type selectively on said one surface. For this purpose, photosensitive liquid (photo-hardening type photoresist) is coated on a thin film condition on predetermined portions of the wafer surface, and is next printed thereon and developed for forming a pattern for etching of oxide film, said pattern providing semiconductor circuits as a semiconductor device.

An apparatus for the above described etching has been known, in which a cup-shaped basin is used for etching a film to be treated, applied on one of the surfaces of a semiconductor material which is supported by a rotatable chuck, spaced above the top portion of the basin, with one surface facing downwardly. The etching of a film applied on one wafer surface is accomplished by introducing an etchant through a passage formed in a lower part of the basin and blowing the etchant upwardly against the one surface of a semiconductor material. An end point of the etching has been determined in accordance with a lapse of a predetermined time.

An end point of the etching should be correctly determined. However, the above described conventional method does not necessarily provide a correct discrimination of an end point of the etching, which results in an over-etching such as "side-etch" or "under-cut", or results in an insufficiency of etching.

SUMMARY OF THE INVENTION

An object of the present invention is to solve the above mentioned defects in the prior art, and therefore to provide an etching apparatus which enables to determine a correct end point of the etching.

An apparatus for etching semiconductor material according to the present invention comprises a cup-shaped basin through which an etchant is blown upwardly, and a rotatable chuck spaced above the basin, lower face of the chuck being adapted to support a semiconductor material by vacuum suction, and further a pair of electrical terminals contacting with the etchant, and a detector conected with the pair of electrical terminals, to thereby detect ionic density in the etchant which has contacted with a semiconductor material supported by the chuck in order to discriminate an etching end point.

The above and other objects, features and advantages of the present invention will become apparent from the following description and the appended claims, taken in conjunction with the accompanying drawings.

BRIEF DESCRIPTION OF THE DRAWINGS

In the accompanying drawings.

DETAILED DESCRIPTION OF PREFERRED EMBODIMENTS

Figure 1:
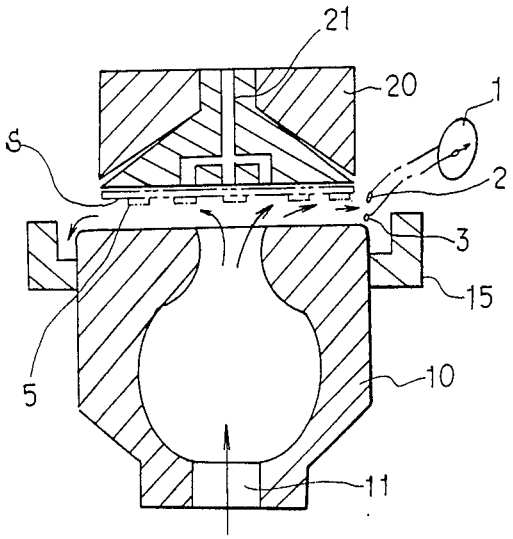
FIG. 1 is a vertical cross-sectional view of main portions of an etching apparatus according to the invention.

Preferred embodiments of this invention will be hereinafter described with reference to the accompanying drawings. FIG. 1 shows main portions of an apparatus embodying the present invention. This apparatus comprises, similarly to the prior art apparatus, a cup-shaped basin (10) formed with a passage (11) for introducing an etchant, and a chuck (20) rotatably mounted, spaced above the basin (10). The chuck (20) is provided with a central passage (21) communicated with a vacuum means (not shown) in order to support a wafer (S) at the lower surface thereof. Etching of a film (4) such as an oxide film applied on one wafer surface is carried out by blowing an etchant upwardly through the passage (11) against the downwardly facing wafer surface. Hydrofluoric acid is usually used for such an etching of an oxide film. Numeral (5) in FIG. 2 denotes a photoresist applied on an oxide film.

Figure 4:
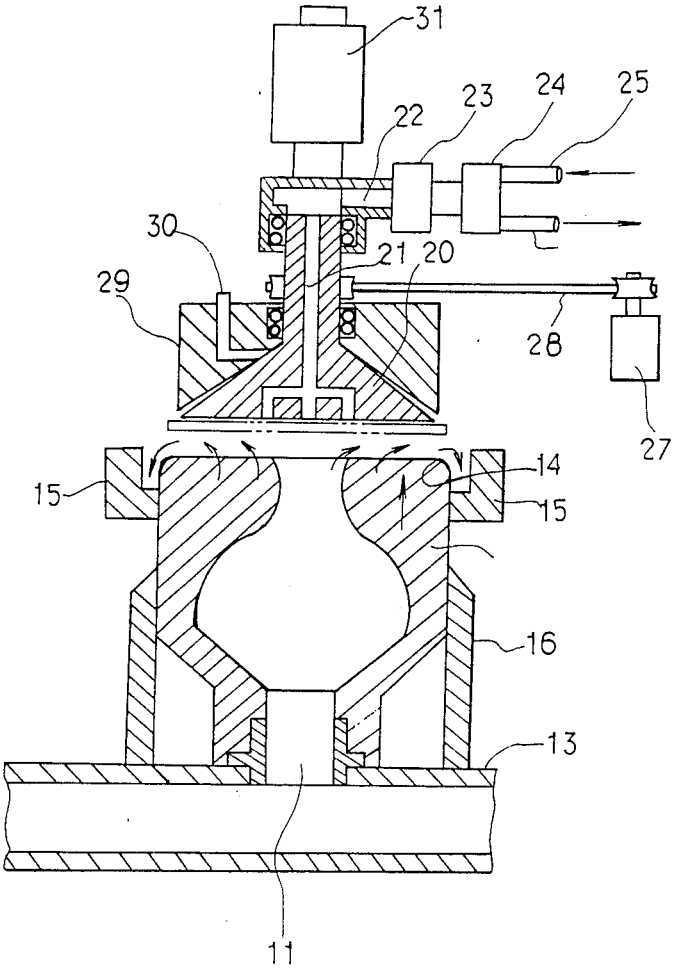
FIG. 4 PRIOR ART
FIG. 4 is a vertical cross-sectional view showing the entirety of a known etching apparatus.

Further, FIG. 4 illustrates a relevant apparatus for the etching. The passage (11) formed in the basin (10) is connected to a feed conduit (13) for an etchant. The top portion (14) of the basin (10) has a circular contour. A gutter (14) of the basin (10) has a circular contour. A gutter (15) is provided around the upper outer peripheral portion of basin (10) to catch the etchant which has flown down from the top periphery of basin (10). Designated at (16) is a cylindrical guide for etchant, mounted on the lower outer peripheral portion of basin (10).

Chuck (20) is vertically supported for rotation, and has a passage (21) formed along the axis thereof. This passage (21) is communicated at the top thereof with a conduit (22) used for vacuum. The conduit (22) is provided with a pressure sensor (23) and a valve (24). The valve (24) is in turn connected to a nitrogen gas feed line (25) and a suction line (26) kept in communication with a vacuum line. Also, chuck (20) is connected with a device for rotation, for example, consisted of a motor (27) and a transmission (28). There is a holder (29) which surrounds the chuck (20). This holder defines a gas feed channel (30) at a suitable position. Designated at (31) is an air cylinder for lifting the chuck (20) slightly.

As shown in FIG. 1, the apparatus according to the invention includes at least a pair of electrical terminals (2), (3) mounted on the basin (10) or adjacent thereto. These electrical terminals are contacted with the etchant in order to measure ionic density in the etchant which has been blown upwardly from the bottom of the basin and contacted with a water surface to be treated in the etching process. The respective electrical terminals (2), (3) are connected with a detector (1). If desired, plural pairs of electrical terminals will be provided in order that the measurement will be performed at plural positions. Variation or change of ionic density will be obtained by detecting a change of current or capacity in the etchant. Preferably, the terminals (2), (3) are disposed at a position so as to contact with the etchant just after contacted with a set wafer.

Figure 2:
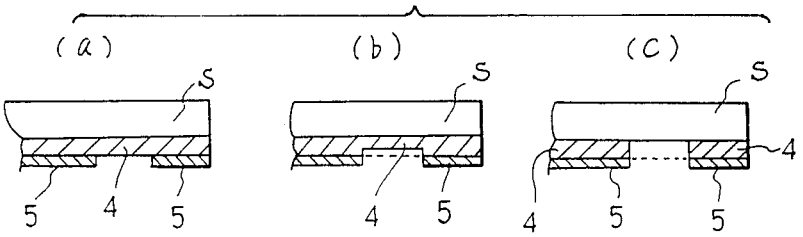
FIG. 2 (*a*), (*b*) and (*c*) are respectively a partial sectional view of a semiconductor material showing a step of etching process.
Figure 3:
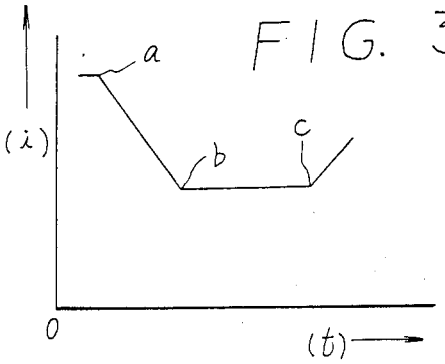
FIG. 3 is a graphic view showing a change of current ( capacity ) in an etchant which has contacted with a semiconductor material.

In etching of an oxide film, current or capacity between the electrical terminals is proportional to density of hydrogen ion in an etchant. Thus, when etching is not performed, i.e., in a condition before etching as shown in FIG. 2 (a), and in case that hydrofluoric acid is used for etching an oxide film, the hydrofluoric acid is decomposed into hydrogen and fluorine or combined in reverse in equalized condition as shown in the following chemical formula, $$HF \rightleftharpoons H^+ + F^-$$

whereby there is generated comparatively more hydrogen ion in the etchant. Thus, current or capacity existing between the terminals becomes relatively high. This condition is shown by point (a) in FIG. 3.

When etching is being performed, as shown by the following chemical formula, oxygen caused from the oxide film is combined with hydrogen ion, which results in water.

$$SiO_2 + 6\,HF \rightarrow H_2SiF_6 + 2H_2O$$

therefore, current or capacity in the etchant is gradually reduced, and an equalized condition is attained at a point of time in the etching process of the oxide film, as shown in FIG. 2 (*b*). This equilibrium is shown by b—c in FIG. 3.

And, when oxide film portions to be treated which are not coated with photo-resist, have been etched entirely as shown in FIG. 2 (c), an increase in hydrogen ion is again initiated and thus current (capacity) is also gradually increased. This condition corresponds to point (c) in FIG. 3. The starting point (c) of the re-increase in current is discriminated by detector (1) and is utilized as an end point of the etching. Any etching over this point (c) will cause over-etching such as side-etch or the like.

Further, although etching of an oxide film has been described in the above embodiment, etching of metallic films such as Al-film, Cr-film or the like will be similarly carried out.

For example, for etching of Al-film, phosphoric acid is used. In a condition before etching, phosphoric acid is decomposed into $H_2$ and $PO_4^-$. Phosphoric acid reacts with the Al-film to be etched, as shown by the following formula.

$$Al + H_3PO_4 \rightarrow Al^{3+} + PO_4^-.$$

Thus, the etchant includes relatively much ion at beginning stage. Then, ionic density in the etchant is gradually reduced, and next, an equliized condition is resulted. Thereafter, an increase in ionic density is started again. This process is similar to the above described one, and also the starting point of re-increase in ionic density is used as an etching end point.

Also, for etching of silicon-film, hydrofluoric acid is used as an etchant, and it reacts with silicon film as shown by the following chemical formula.

$$3Si + 4HNO_3 + 18HF \rightarrow 3H_2SiF_630$$
$$4NO^+ + 8H_2O + \alpha$$

In this case, etching end point can be discriminated according to changes of ionic density similarly to the described case relating to an oxide film.

As mentioned above, according to the invention, an etching end point is given as a starting point of re-increase in current or capacity in an etchant from an equalized condition. Therefore, an etching end point can be discriminated easily and accurately. This effects an adequate etching of a film such as an oxide film without over-etching or insufficiency of etching.

Having now fully described the invention, it will be apparent to one of ordinary skill in the art that many changes and modifications can be made thereto without departing from the spirit or scope of the invention as set forth herein.

I claim:

1. In an apparatus for etching film formed on a surface of a semiconductor material including a cup-shaped basin having a pasasge formed in a lower portion thereof for introducing etchant therethrough, said etchant having a measurable ionic density, and a rotatable chuck spaced above a top portion of the basin for holding the semiconductor material with a surface of the semiconductor material pointing downwardly so that etchant is blown upwardly against the semiconductor material, the improvement comprising at least a pair of electrical terminals in contact with the etchant and detecting means electrically connected to said electrical terminals for measuring ionic density and detecting a point where the ionic density of the etchant changes from an essentially constant value to an increasing value, to thereby determine an etching end point.

2. An apparatus as claimed in claim 1, wherein one pair of electrical terminals are disposed to contact with the etchant immediately after contact with a semiconductor material.

3. An apparatus as claimed in claim 1, wherein hydrofluoric acid is used as an etchant.

4. An apparatus as claimed in claim 3, wherein the film to be treated is an oxide film.

5. An apparatus as claimed in claim 3, wherein the film to be treated is a silicon film.

6. An apparatus as claimed in claim 1, wherein the film to be treated is an aluminum film, and phosphoric acid is used as an etchant.

* * * * *